US006401673B2

(12) United States Patent
Linsbauer et al.

(10) Patent No.: US 6,401,673 B2
(45) Date of Patent: Jun. 11, 2002

(54) TWO-STROKE ENGINE HAVING A BYPASS BRANCHING FROM AN AIR FILTER HOUSING

(75) Inventors: Peter Linsbauer, Remshalden; Lars Bergmann, Welzheim; Heiko Rosskamp, Adelberg; Reinhard Gerhardy, Korb, all of (DE)

(73) Assignee: Andreas Stihl AG & Co., Waiblingen (DE)

( * ) Notice: Subject to any disclaimer, the term of this patent is extended or adjusted under 35 U.S.C. 154(b) by 0 days.

(21) Appl. No.: 09/795,392

(22) Filed: Mar. 1, 2001

(30) Foreign Application Priority Data

Mar. 1, 2000 (DE) ..... 100 09 794

(51) Int. Cl.[7] ..... F02B 25/20
(52) U.S. Cl. ..... 123/73 PP; 123/184.23
(58) Field of Search ..... 123/73 A, 73 AA, 123/73 PP, 184.23

(56) References Cited

U.S. PATENT DOCUMENTS 5,379,743 A * 1/1995 Mavinahahlly et al. . 123/73 AA
6,216,650 B1 * 4/2001 Noguchi ..... 123/73 A
6,257,181 B1 * 7/2001 Rosskamp et al. ..... 123/73 AA
6,267,088 B1 * 7/2001 Rosskamp et al. ..... 123/73 PP

* cited by examiner

*Primary Examiner*—Marguerite McMahon
(74) *Attorney, Agent, or Firm*—Walter Ottesen

(57) ABSTRACT

The invention relates to a two-stroke engine for a portable handheld work apparatus such as a motor chain saw. The combustion chamber (3), which is configured in a cylinder (2), is delimited by a piston (5) which drives a crankshaft (7) rotatably journalled in a crankcase (4). The crankcase (4) is connected to the combustion chamber (3) via a transfer channel (14). A first end (20) of the transfer channel (14) opens into the combustion chamber (3) via an entry window (12, 15) lying in the cylinder wall (16); whereas, the second end (19) of this transfer channel (14) is open toward the crankcase (4). The transfer channel (14) is connected between its ends (19, 20) to an air channel (22a, 22b) via a check valve (21). The air channel (22a, 22b) supplies essentially fuel-free gas via a throttle (31) having an adjustable throttle element (33). A mixture-preparation device (8) is provided for the air/fuel mixture downstream of an air filter (42) in the flow direction of the combustion air. The air/fuel mixture is supplied via an inlet (11) to the crankcase (4). In order to meter clean air to the air channels in a controlled manner, an adjustable throttle element (33) is mounted in a throttle channel (36) of an independent throttle housing (31) and the throttle channel (36) is connected upstream of the throttle element to the clean space (51) of the air filter (42) connected ahead of the mixture-preparation device (8).

13 Claims, 4 Drawing Sheets

TWO-STROKE ENGINE HAVING A BYPASS BRANCHING FROM AN AIR FILTER HOUSING

FIELD OF THE INVENTION

The invention relates to a two-stroke engine and especially a drive engine in a portable handheld work apparatus including a motor chain saw, a brushcutter, cutoff machine or the like.

BACKGROUND OF THE INVENTION

In a known two-stroke engine of this kind, air is supplied via the air channel and the check valve to each transfer channel or the transfer channel close to the outlet during the induction phase. During a gas exchange, the air, which is stored in the transfer channel, is pushed into the combustion chamber by the air/fuel mixture following on from the crankcase. In this way, scavenging losses are reduced and therefore the quality of the exhaust gas is improved.

For metering the fuel-free gas, which is to be supplied to the transfer channel, a throttle is mounted in the air channel and this throttle is configured as a throttle flap. The throttle flap is purposefully coupled to the carburetor throttle flap in order to meter the air, which is to be supplied to the transfer channel, in correspondence to the operating state of the two-stroke engine. For this purpose, the throttle flap has to be adapted to the throttle channel; especially, it should be ensured that, when starting the engine, virtually no fuel-free gas can enter into the transfer channel via the air channel. This is so because this can lead to a leaning of the mixture and therefore to starting difficulties associated therewith.

SUMMARY OF THE INVENTION

It is an object of the invention to improve a two-stroke engine so that the precise metering of the fuel-free gas into the transfer channels is ensured with a minimum of constructive complexity.

The two-stroke engine of the invention includes an engine in a portable handheld work apparatus. The two-stroke engine includes: a cylinder having a cylinder wall; a piston mounted in the cylinder to undergo a reciprocating movement along a stroke path between top dead center and bottom dead center during operation of the engine; the cylinder and the piston conjointly delimiting a combustion chamber; a crankcase connected to the cylinder; a crankshaft rotatably mounted in the crankcase; a connecting rod connecting the piston to the crankshaft to permit the piston to drive the crankshaft as the piston reciprocates in the cylinder; at least one transfer channel connecting the crankcase to the combustion chamber; the transfer channel having a first end defining an entry window opening into the combustion chamber and a second end opening into the crankcase; an air filter having an air filter housing defining a clean space; a choke throttle unit for conducting essentially fuel-free air from the air filter; an air channel connected to the transfer channel for supplying the essentially fuel-free gas flow thereto from the choke throttle unit; a mixture-preparation unit for supplying an air/fuel mixture; the mixture-preparation unit being mounted downstream of the air filter; an inlet channel downstream of the mixture-preparation unit for conducting the air/fuel mixture into the crankcase; the choke throttle unit including: an independent choke housing defining choke channel communicating with the air channel; and, a throttle element adjustably mounted in the choke channel; and, the choke housing being attached to the air filter housing and the choke channel being connected to the clean space of the air filter upstream of the choke element.

The adjustable throttle element is arranged in a throttle channel of an independent throttle housing which can be configured to the requirements of the adjustment accuracy. The throttle channel is connected to the clean air side of the air filter upstream of the throttle flap so that a separate air filter is unnecessary for the air which is advance-stored in the transfer channel. The air filter is connected forward of the mixture-preparation device. The needed air volume of the engine is made available for each operating point thereof via the air filter.

Preferably, the throttle housing is made of plastic and is configured especially as a plastic injection molded part. The throttle element is mounted in a pipe or tube section made of metal which defines a channel in order the ensure manufacture as a mass-produced item while guaranteeing high accuracy of the throttle flap fit. The pipe section can be injection molded in the throttle housing. In this way, the throttle flap can be fitted in the pipe section so as to be approximately seal tight in the closed position and can effectively block the fuel-free supply of gas into the transfer channel for the starting case.

The throttle flap housing is purposefully attached to the housing base of the air filter and a corresponding connection support can be provided for this purpose. The throttle housing is advantageously configured as one piece with the air filter and especially with the housing base of the air filter housing.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
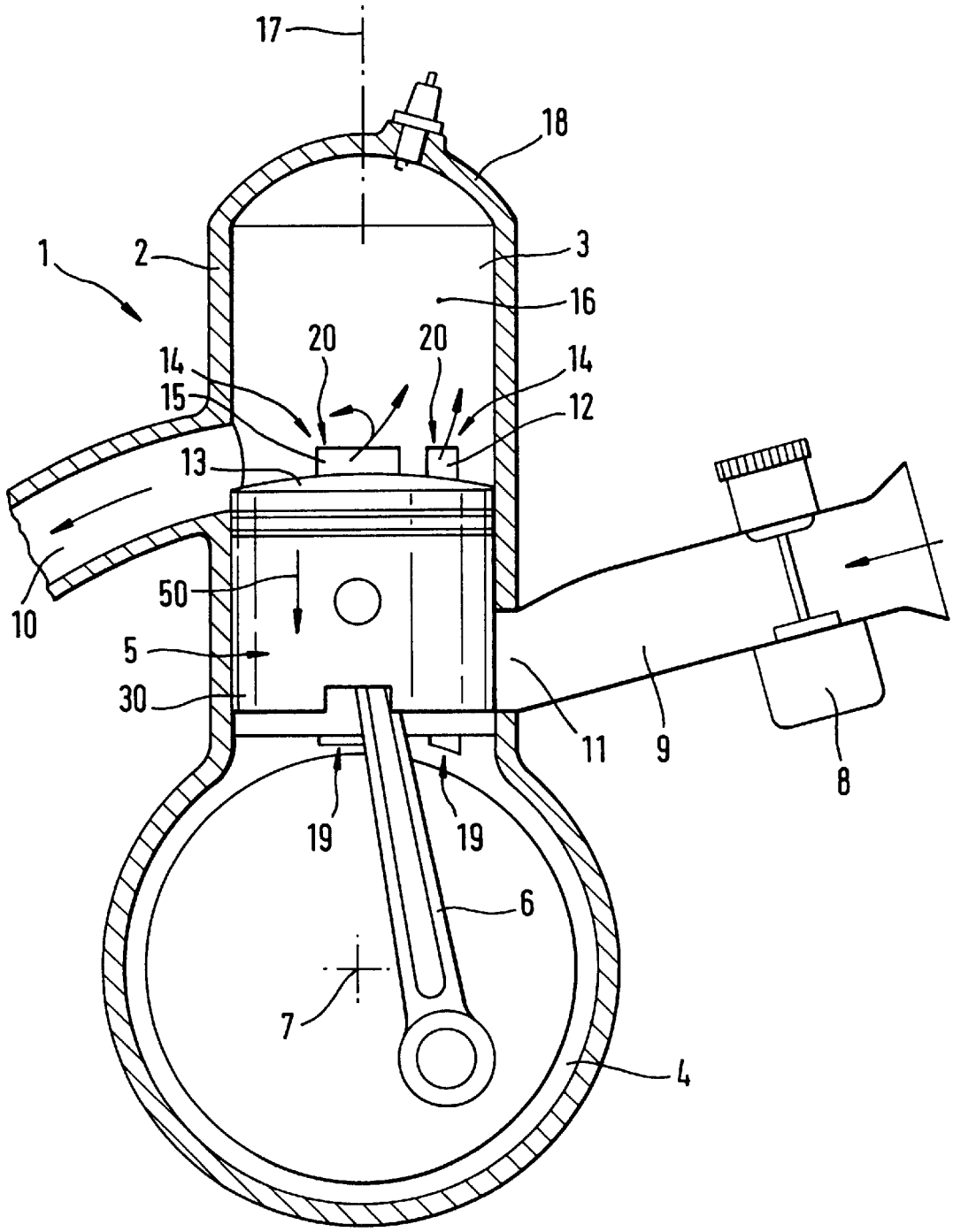
FIG. 1 is a schematic section view taken through a two-stroke engine having transfer channels lying on opposite sides of the cylinder.

The two-stroke engine 1 shown schematically in FIG. 1 comprises essentially a cylinder 2 and a piston 5 which moves upwardly and downwardly therein. The piston 5 imparts rotational drive movement via a connecting rod 6 to a crankshaft 7 mounted in a crankcase 4.

A combustion chamber 3 is formed in the cylinder 2 and is delimited by the base 13 of the piston 5. The combustion chamber 3 includes an outlet 10 via which combustion gases are conducted away after a work stroke. The air/fuel mixture, which is necessary to operate the two-stroke engine 1, is supplied to the crankcase 4 from a mixture-preparation device 8 via an inlet 11 and an inlet channel 9. The mixture-preparation device 8 is preferably a carburetor and especially a membrane carburetor.

The inlet 11 is controlled by the piston surface 30 in the embodiment shown. In the stroke position of the piston 5 shown in FIG. 1, the inlet 11 is completely closed by the piston surface 30. The air/fuel mixture, which is inducted into the crankcase 4, is therefore compressed with the further downward movement of the piston in the direction of arrow 50 toward bottom dead center and flows over into the combustion chamber 3 via transfer channels 14 and respective entry windows (12, 15) in the cylinder wall 16.

Figure 2:
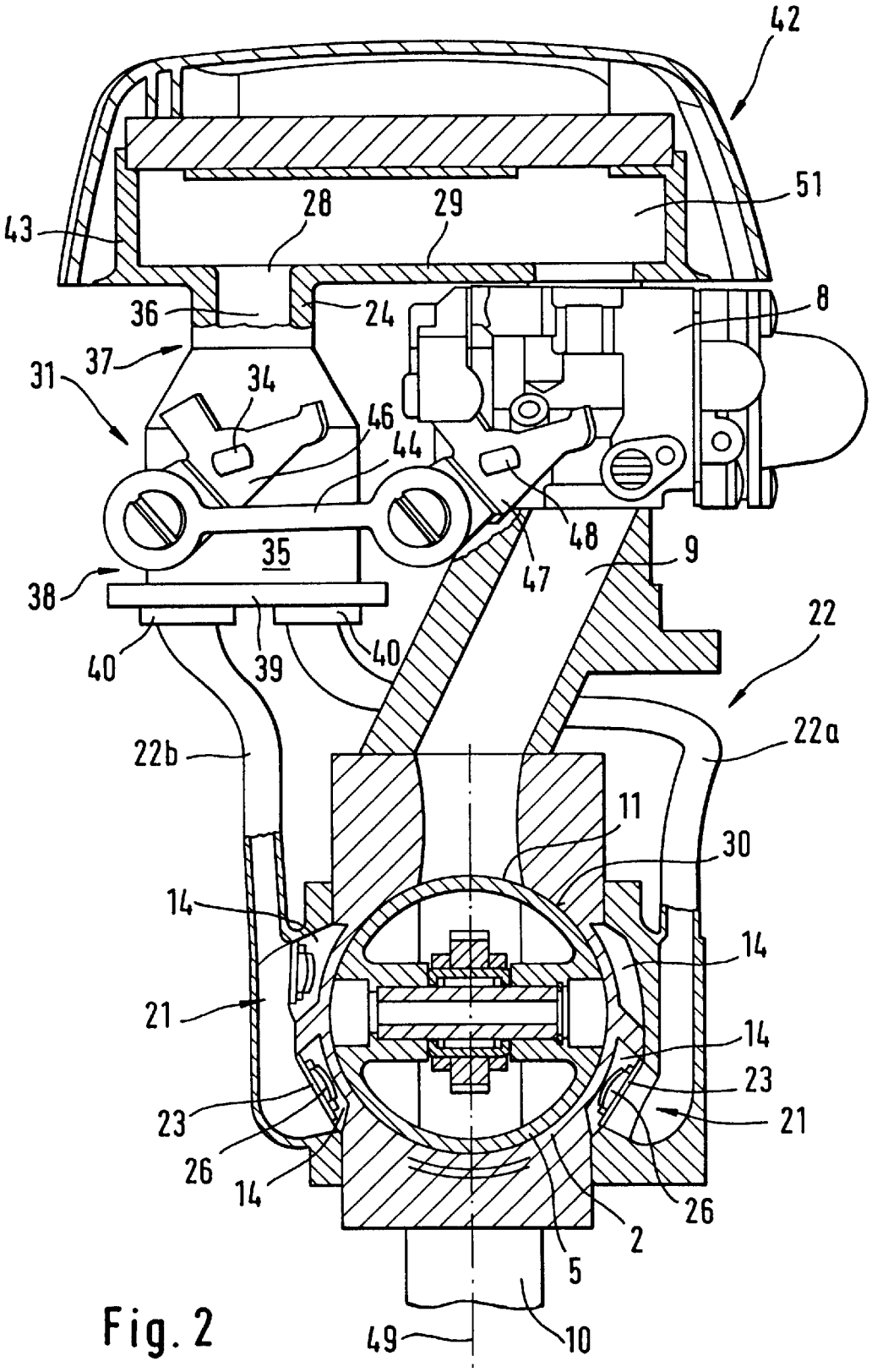
FIG. 2 is a section view through a cylinder having air channels opening into the transfer channels.

As shown in FIGS. 1 and 2, two overflow channels are arranged on each side of a symmetry plane 49. A two-stroke engine configured in this manner can be operated in accordance with the scavenging principle (principle of advanced air) as well as in accordance with the principle of charge stratification depending upon the control and arrangement of the air channels. The symmetry plane 49 runs through the cylinder axis 17 and approximately partitions the outlet 10 and the inlet 11.

In the embodiment, each transfer channel 14 runs in the cylinder wall approximately parallel to the cylinder axis 17. The transfer channel 14 can also have a configuration departing from the embodiment shown, so, for example, the transfer channel 14 can run curved in the flow direction.

The first end 20 of the transfer channel 14 faces toward the cylinder head 18 and opens into the combustion chamber 3 via an entry window (12 or 15); whereas, the second end 19 of the transfer channel 14 faces toward the crankcase 4 and is open thereto. The transfer channels 14 are configured closed to the piston 5. The transfer channels 14 which open into the combustion chamber with the entry windows 12 are channels remote from the outlet 10; correspondingly, the transfer channels 14, which open into the combustion chamber via the transfer window 15 are channels close to the outlet 10.

In the embodiment shown, a transfer channel 14 is connected to an air channel (22*a* or 22*b*) between the first end 20 and the second end 19. A check valve 21 closes the flow connection between the air channel (22*a* or 22*b*) and the transfer channel 14 and opens into the transfer channel 14. The check valve 21 is configured as a membrane valve in the embodiment shown. The membrane 23 clears an outlet slot in the open position and this outlet slot preferably faces toward the roof of the transfer channel 14. Each membrane 23 is supported by a sheet metal support 26 in its open position.

In FIG. 2, an air channel 22*a* is shown on the right side of the drawing and opens via a check valve 21 into the transfer channel 14 close to the outlet 10. The feeding of fuel-free gas, especially air, only into the transfer channel 14 close to the outlet 11 makes possible an operation of the engine in accordance with the stratified charge principle insofar as only air is supplied via the transfer channel 14 close to the outlet and its entry window 15 over the entire time span of the gas exchange. If the air quantity, which is inducted into the transfer channel 14 close to the outlet 11, is reduced, then, at the end of the gas exchange, mixture would also transfer from the crankcase via the outlet-near transfer channel 14 insofar as a channel connection is provided as shown in the left half of FIG. 2. The engine is then operated in accordance of the principle of advanced air.

On the left-hand side of FIG. 2, another configuration of the fuel-free gas supply is shown. There, air flows into the combustion chamber 3 via the channel 22*b* into the outlet-near transfer channel 14 as well as the outlet-remote transfer channel 14. Since both transfer channels 14 are fed in common by air channel 22*b*, a two-stroke engine configured in this manner is operated in accordance with the principle of advanced air. Air is stored in advance in the transfer channels during the induction phase which, at the start of a gas exchange, first flows into the combustion chamber and is then followed by the mixture following on from the crankcase.

Figure 3:
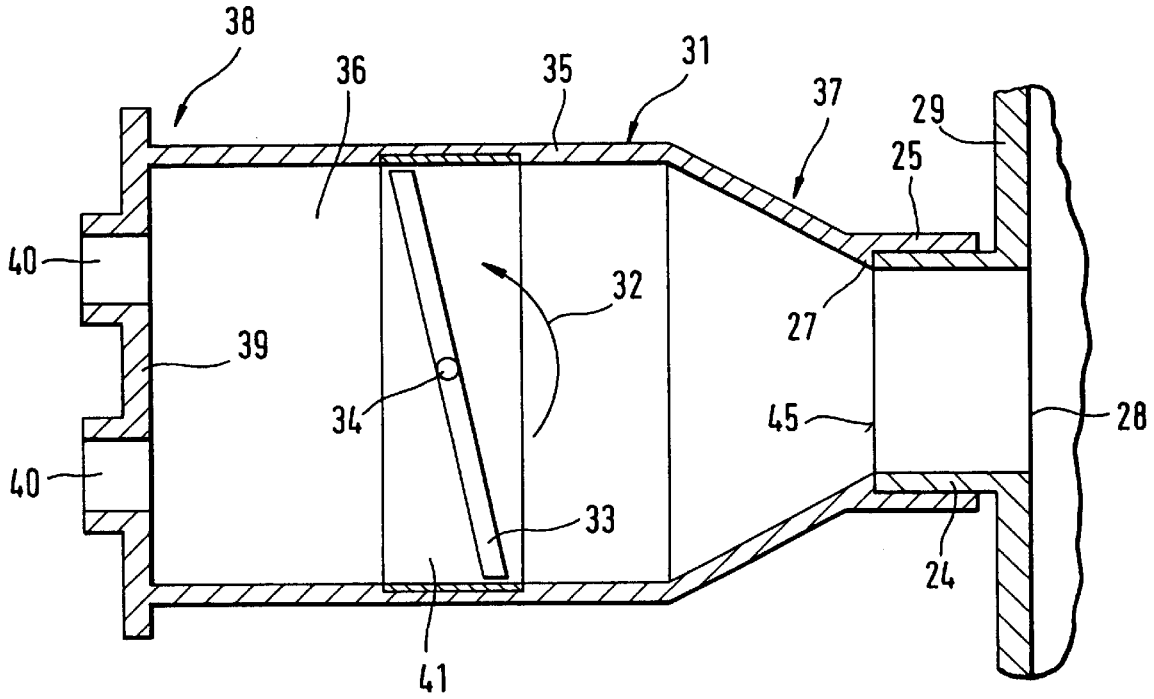
FIG. 3 is a longitudinal section through a throttle unit having a throttle housing and a throttle flap with the throttle unit being arranged in the air channel.
Figure 4:
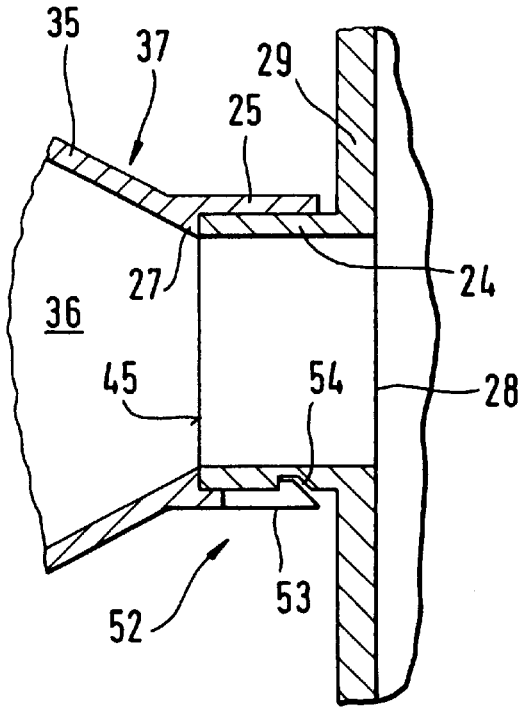
FIG. 4 is a detail view of the connection of the throttle housing of FIG. 3 to an air filter housing; and, FIG. 5 is a further embodiment of a connection of the throttle housing to an air filter housing.

The air channels 22*a* and 22*b* are connected to a common throttle housing 35 of a throttle 31 independently of the type of feed of the air into the transfer channels. As shown in FIG. 3, the throttle housing 35 includes a throttle flap 33 as a throttle element and this throttle flap is pivotable in the direction of arrow 32. In lieu of a throttle flap 33, a cylinder or like element can be provided. The throttle flap 33 is pivotably journalled by means of a throttle flap shaft pin 34 in the throttle channel 36 of the throttle housing 35. The throttle housing 35 is attached with its end 37 to the air filter housing 43 and preferably to the housing base 29. The end 37 of the throttle housing 35 has a tapered configuration and corresponds in diameter approximately to the diameter of a bypass opening 28 which is provided in the housing base 29 for branching off clean air from the air filter 42.

The throttle channel 36 of the throttle housing 35 is closed by an end wall 39 at its other end 38. Two connecting stubs 40 are configured in the end wall 39 for connecting to the air channels 22*a* and 22*b*. The throttle housing 35 comprises plastic and preferably fiber-reinforced plastic and is configured as a one-piece plastic injection molded part. Duroplast can, for example, be used.

The throttle flap 33 can be adjusted via a throttle flap lever 46 connected to the throttle flap shaft pin 34 so that lever 46 and shaft pin 34 cannot rotate relative to each other. The throttle flap lever 46 is position-dependently coupled to the shaft 48 of the carburetor throttle flap via an actuating rod 44 and a throttle flap lever 47. The actuating rod 44 is preferably adjustable with respect to its length. The displacement kinematic can be determined via the length of the rod 44 and the pivot connecting points on the throttle flap levers 46 and 47.

The throttle element, which is configured as throttle flap 33, is mounted in a pipe section 41 of metal in order to ensure that the throttle channel 36 is essentially closed seal tight in the closed position of the throttle flap 33 shown in FIG. 3 independently of the shrinkage characteristic of the plastic used for the manufacture of the throttle housing 35. The pipe section 41 defines a channel. The throttle flap shaft pin 34 is likewise journalled in the pipe section 41. The pipe section 41 is injection molded into the throttle housing 35 or is axially inserted therein. This can be done in a simple manner by placing the pipe section 41 in the manufacturing mold. In this way, dimensions can be maintained with little scattering even in series production independently of the accuracy in the injection molding process. The throttle flap 33 and the pipe section 41 are made of metal which can be manufactured to high accuracy. The other air-conducting regions and the connecting regions of the throttle housing 35 can be manufactured of a simple plastic material without special quality requirements. This makes the manufacture of the throttle housing cost effective. Here, it can be especially provided that the throttle housing 35 is configured as one piece with the air filter housing 43.

It can be practical to configure the throttle housing separate from the air filter housing 43 which can be especially advantageous in the assembly of the air channels 22*a* and 22*b* provided as tubes 22. It is practical to provide a connecting stub 24 configured as a pipe stub on the housing base 29. This connecting stub 24 is telescopically engaged by a sleeve-shaped receiving stub 25 of the throttle housing 35. As shown in FIG. 3, an annular shoulder 27 is formed at the inner end of the receptacle stub 25. The end face 45 of the connecting stub 24 comes into contact engagement with the annular shoulder 27 and thereby delimits the insert depth. In this way, it is ensured that the throttle housing 35 is connected with an accurate fit in a defined end position on the housing base 29 of the air filter housing 43 in order to supply fuel-free gas to the transfer channels 14 via the bypass opening 28 from the clean space 51 of the air filter while bypassing the carburetor 8.

A latch connection 52 can be provided to attach the throttle housing 35 to the air filter housing 43 so that it cannot separate therefrom. The latch connection 52 can comprise latch tongues 53 configured in the wall of the receiving stub 25. The latch tongues 53 can, with their latch ends, latch into corresponding latch recesses 54 of the connecting stub 24. A form-tight attachment on the housing base 29 is ensured by a simple push-on of the throttle housing 35 onto the connecting stub 24 of the filter housing 43 so that the receiving stub 25 and the connecting stub 24 do not separate from each other.

Figure 5:
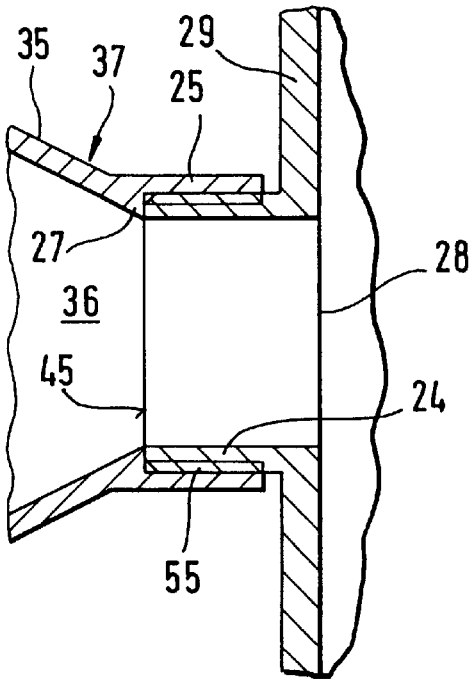

As shown in FIG. 5, a threaded connection 55 can be provided between the connecting stub 24 and the receiving stub 25. A form-tight connection of this kind with the housing base 29 must, however, be assembled before connecting the tubes 22. A loosening of the threaded connection in operation is prevented because of the lever connection of the throttle flap levers 46 and 47 via the actuating rod 44.

It is understood that the foregoing description is that of the preferred embodiments of the invention and that various changes and modifications may be made thereto without departing from the spirit and scope of the invention as defined in the appended claims.

What is claimed is:

1. A two-stroke engine including an engine in a portable handheld work apparatus, the two-stroke engine comprising:

a cylinder having a cylinder wall;

a piston mounted in said cylinder to undergo a reciprocating movement along a stroke path between top dead center and bottom dead center during operation of said engine;

said cylinder and said piston conjointly delimiting a combustion chamber;

a crankcase connected to said cylinder;

a crankshaft rotatably mounted in said crankcase;

a connecting rod connecting said piston to said crankshaft to permit said piston to drive said crankshaft as said piston reciprocates in said cylinder;

at least one transfer channel connecting said crankcase to said combustion chamber;

said transfer channel having a first end defining an entry window opening into said combustion chamber and a second end opening into said crankcase;

an air filter having an air filter housing defining a clean space;

a choke throttle unit for conducting essentially fuel-free air from said air filter;

an air channel connected to said transfer channel for supplying said essentially fuel-free gas flow thereto from said choke throttle unit;

a mixture-preparation unit for supplying an air/fuel mixture;

said mixture-preparation unit being mounted downstream of said air filter;

an inlet channel downstream of said mixture-preparation unit for conducting said air/fuel mixture into said crankcase;

said choke throttle unit including: an independent choke housing defining a choke channel communicating with said air channel; and, a throttle element adjustably mounted in said choke channel; and, said choke housing being attached to said air filter housing and said choke channel being connected to said clean space of said air filter upstream of said choke element.

2. The two-stroke engine of claim 1, wherein said throttle housing is made of plastic.

3. The two-stroke engine of claim 2, wherein said throttle housing is manufactured as a plastic injection-molded part.

4. The two-stroke engine of claim 2, wherein said throttle housing includes a metal tube section defining at least a part of said choke channel; and, said throttle element being mounted in said metal tube section.

5. The two-stroke engine of claim 4, wherein said metal tube section is injection molded into said throttle housing.

6. The two-stroke engine of claim 4, wherein said metal tube section is pressed into said throttle housing.

7. The two-stroke engine of claim 4, wherein said throttle element can be displaced into a closed position so as to be disposed approximately seal tight in said metal tube section.

8. The two-stroke engine of claim 1, wherein said air filter housing has a base wall and said choke housing is attached to said base wall.

9. The two-stroke engine of claim 1, wherein said air filter housing has a base wall and said choke housing is formed as a single piece with said base wall.

10. The two-stroke engine of claim 1, wherein said air filter housing has a connecting stub formed thereon; and, said choke housing is attached to said connecting stub.

11. The two-stroke engine of claim 1, wherein said air filter housing has a connecting stub formed thereon; and, said choke housing is held axially form tight on said connecting stub.

12. The two-stroke engine of claim 1, wherein said mixture-preparation device is a carburetor having a throttle flap; and, said engine further comprising a lever linkage for position dependently coupling said throttle element and said throttle flap to each other.

13. The two-stroke engine of claim 12, wherein said lever linkage includes an actuating rod which can be changed in length.

* * * * *